US005555974A

United States Patent [19]

Donald et al.

[11] Patent Number: 5,555,974

[45] Date of Patent: Sep. 17, 1996

[54] ENCLOSURE WITH OXYGEN SCAVENGING MATERIAL FOR STORING PAINTS MIXED ON ARTIST'S PALETTE

[75] Inventors: Donell C. Donald, 8850 Ferguson Rd., Suite 2063, Dallas, Tex. 75228; Morgan H. Dunn, Carrollton, Tex.

[73] Assignee: Donell C. Donald, Dallas, Tex.

[21] Appl. No.: 371,097

[22] Filed: Jan. 11, 1995

[51] Int. Cl.[6] ..... B44D 7/00

[52] U.S. Cl. ..... 206/1.7; 206/205; 220/355; 312/31.1

[58] Field of Search ..... 220/761, 754, 220/355; 206/1.7–1.9, 204, 205; 312/31.1, 31.2, 31

[56] References Cited

U.S. PATENT DOCUMENTS

| | | | |
|---|---|---|---|
| D. 234,573 | 3/1975 | Maxwell . | |
| 265,609 | 10/1882 | Johnston . | |
| 2,728,157 | 12/1955 | Guthrie . | |
| 2,826,332 | 3/1958 | Hudson | 220/761 |
| 2,923,081 | 2/1960 | Donald et al. | 312/31 |
| 2,955,889 | 10/1960 | Brokamp . | |
| 2,994,404 | 8/1961 | Schifferly | 206/204 X |
| 3,280,966 | 10/1966 | Boniface | 206/1.7 |
| 3,487,972 | 1/1970 | Swett | 220/355 X |
| 3,672,742 | 6/1972 | Barg | 206/1.7 X |
| 3,885,666 | 5/1975 | Maxwell | 206/1.7 |
| 3,885,843 | 5/1975 | Rubel | 206/1.7 X |
| 3,924,733 | 12/1975 | DeLong | 206/1.7 |
| 3,945,490 | 3/1976 | Thompson | 206/1.7 |
| 4,142,627 | 3/1979 | Szegi | 206/1.7 |
| 4,279,350 | 7/1981 | King . | |
| 4,444,306 | 4/1984 | Benaquista | 206/1.7 |
| 4,579,223 | 4/1986 | Otsuka et al. | 206/204 |
| 4,667,814 | 5/1987 | Wakamatsu et al. . | |
| 5,353,925 | 10/1994 | Lennen et al. . | |

*Primary Examiner*—Bryon P. Gehman

*Attorney, Agent, or Firm*—Marc A. Hubbard; Winstead Sechrest & Minick P.C.

[57] ABSTRACT

A sealable enclosure is specially adapted to hold a conventional tablet of paper palettes or a reusable palette having paints mixed thereon to prevent drying of the paints. Within the enclosure is attached a packet of oxygen scavenging material for preventing polymerization of oil-based paints on the palette. An improved seal slows drying of acrylic paints. The enclosure fabricated from injection molded plastic having a neutral color.

16 Claims, 4 Drawing Sheets

ENCLOSURE WITH OXYGEN SCAVENGING MATERIAL FOR STORING PAINTS MIXED ON ARTIST'S PALETTE

FIELD OF THE INVENTION

The invention relates generally to sealed enclosures for storing an artist's palette on which has been mixed paint.

BACKGROUND OF THE INVENTION

One popular and widely practiced form of artistic expression is painting. In its conventional form, painting involves applying either oil or acrylic based paints to a flat surface, typically a stretched canvas, using a brush. Oil and acrylic paints are packaged and sold to artists in collapsible tubes with screw-on tops. An artist squeezes paint from the tube and onto a palette, where it may be mixed with other paints before applying it. Typically, a number of paint colors are placed on a palette, creating a palette of colors, when preparing to paint. It is often advantageous or necessary to pre-mix an amount of paint sufficient to cover a portion of a canvas being worked on. However, an artist may stop work on this portion of the canvas for a period of between several hours to several weeks. All paints begin drying after leaving the tube. Consequently, much of the pre-mixed paint will likely dry on the palette before being used. It has been estimated that between twenty-five and forty percent of paint that is purchased by an average or typical artist or painter is lost due to drying.

There are several prior art attempts that attempt to solve this problem. In U.S. Pat. No. 2,728,157, Guthrie discloses an "artist's kit" that includes a pallet that may be folded in half and placed within a zippered pouch along with paints and brushes. Paints may remain on the palette. An "anti-skinning" fluid, which is either polyhydric alcohol or tripentaerythritol, is sprayed into the pouch before closing. The anti-skinning fluid vaporizes and, purportedly, slows drying of paints. However, too much of the fluid in the pouch will cause paints on the palette to run. Consequently, small amounts of the anti-skinning fluid must be applied repeatedly to maintain adequate amounts of vapor within the enclosure. Furthermore, these anti-skinning agents chemically react with paint, potentially harming the paint. They are also combustible and give off noxious odors. Many artists today also prefer to use throw-away paper palettes rather than wood or plastic palettes which must be cleaned. Paper palettes are sold in tablets which cannot easily be folded and stuffed into a pouch.

Maxwell, in U.S. Pat. No. 3,885,666, discloses an enclosure having a rectangular, box-shaped bottom large enough to receive an unfolded, throw-away palette. A plastic lid seals against the bottom and includes projections which extend downward for assisting in holding the palette with paint in place within the enclosure. However, the seal of Maxwell's enclosure requires application of petroleum jelly in a groove on the lid and tends not be effective in preventing drying of paint on the palette.

Artist's paints are expensive. It is, for example, not uncommon for art students to spend $1,500 or more a year on paints for classes. Furthermore, time which can otherwise be used for creative activity or, in the case of students, teaching is lost when paints must be freshly mixed at the beginning of each painting session. Since the pouch of Guthrie and the enclosure of Maxwell have several disadvantages, there remains a need for a better device for preserving artist's paints on a palette.

SUMMARY OF THE INVENTION

The invention provides for an improved device in which to store paint on an artist's palette having several advantages over the prior art devices.

According to the invention, placed within an enclosure sized to hold a conventional tablet of paper palettes is an oxygen scavenging material which absorbs oxygen within the container. Removing or scavenging oxygen from inside the enclosure prevents oil-based paints from drying or polymerizing and is harmless to paints and to people. Unlike prior art devices which rely solely on sealing the enclosure or using an anti-skinning agent to slow drying, an enclosure according to the present invention will prolong almost indefinitely oil paints on the palette without the need to repeatedly spray into the enclosure solvents or other harmful chemicals. An enclosure according to the invention thus saves time normally required for setting up, mixing and matching colors and cleaning up. Teachers, students and working artists benefit especially from the time saved since it frees additional time for creative activity and teaching.

According other aspects of the invention, the oxygen scavenger is enclosed within an easily replaceable air-permeable package. The package may include an adhesive backing for adhering the package to an inside surface of the enclosure, enabling easy replacement of the package. According to still other aspects of the invention, the enclosure includes an improved seal that does not require use of a sealant. The seal significantly slows the drying process of acrylic paint, enabling storing of acrylic paint on a palette within the enclosure for several weeks or months without significant loss due to drying.

In a preferred embodiment of the invention, the enclosure is fabricated from injection-molded plastic having a neutral or gray color that reflects light evenly across the spectrum and thus does not cause tinting of paint on the palette. Paints may be mixed accurately on the palette while it remains in the enclosure with its lid removed. The enclosure is further adapted to receive and retain a removable tray for storing brushes and other tools used by an artist that may be covered in paint. A retractable handle on the enclosure enables easy carrying of the containers while permitting storage in tight places.

Additional advantages and aspects of the invention will be apparent from the following description of the preferred embodiments of the invention taken in conjunction with the accompanying drawings.

DESCRIPTION OF THE PREFERRED EMBODIMENT

In the following description, like numbers refer to like parts.

Figure 1:
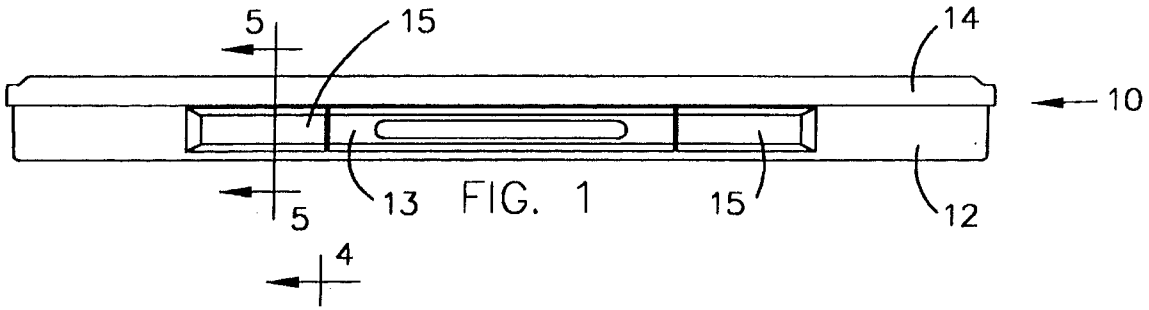
FIG. 1 is a side elevation of a sealable palette enclosure.
Figure 2:
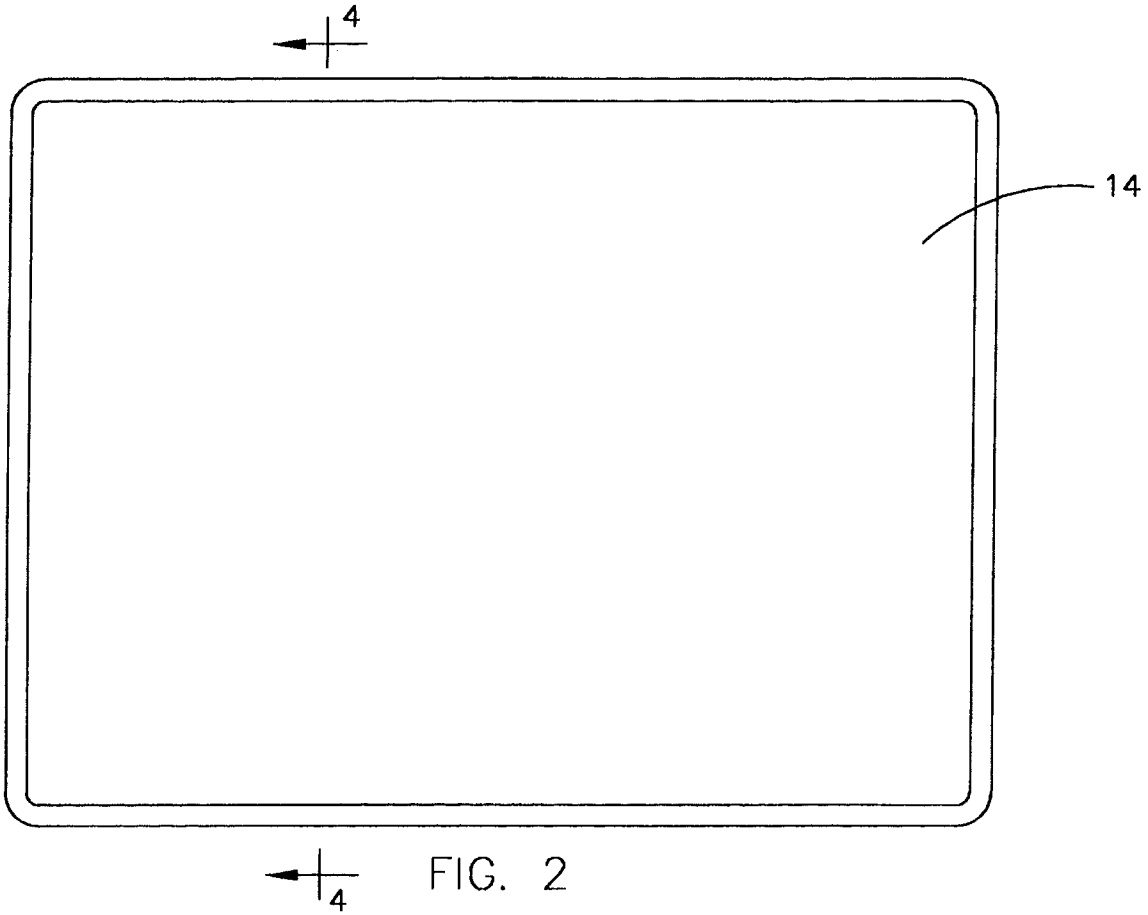
FIG. 2 is a top view of the sealable palette enclosure of FIG. 1.

Referring to FIGS. 1 and 2, enclosure 10 includes a rectangular box 12 and a lid 14. The width and length of the box approximate those of a conventional paper palette. A retractable strap handle 13 is attached at each end to one side wall of the box using connectors 15. It is not unusual for an artist or student to carry twenty to thirty pounds of material. The retractable handle thus eases the burden of carrying materials without significantly increasing the dimensions of the box for easier storage.

Figure 3:
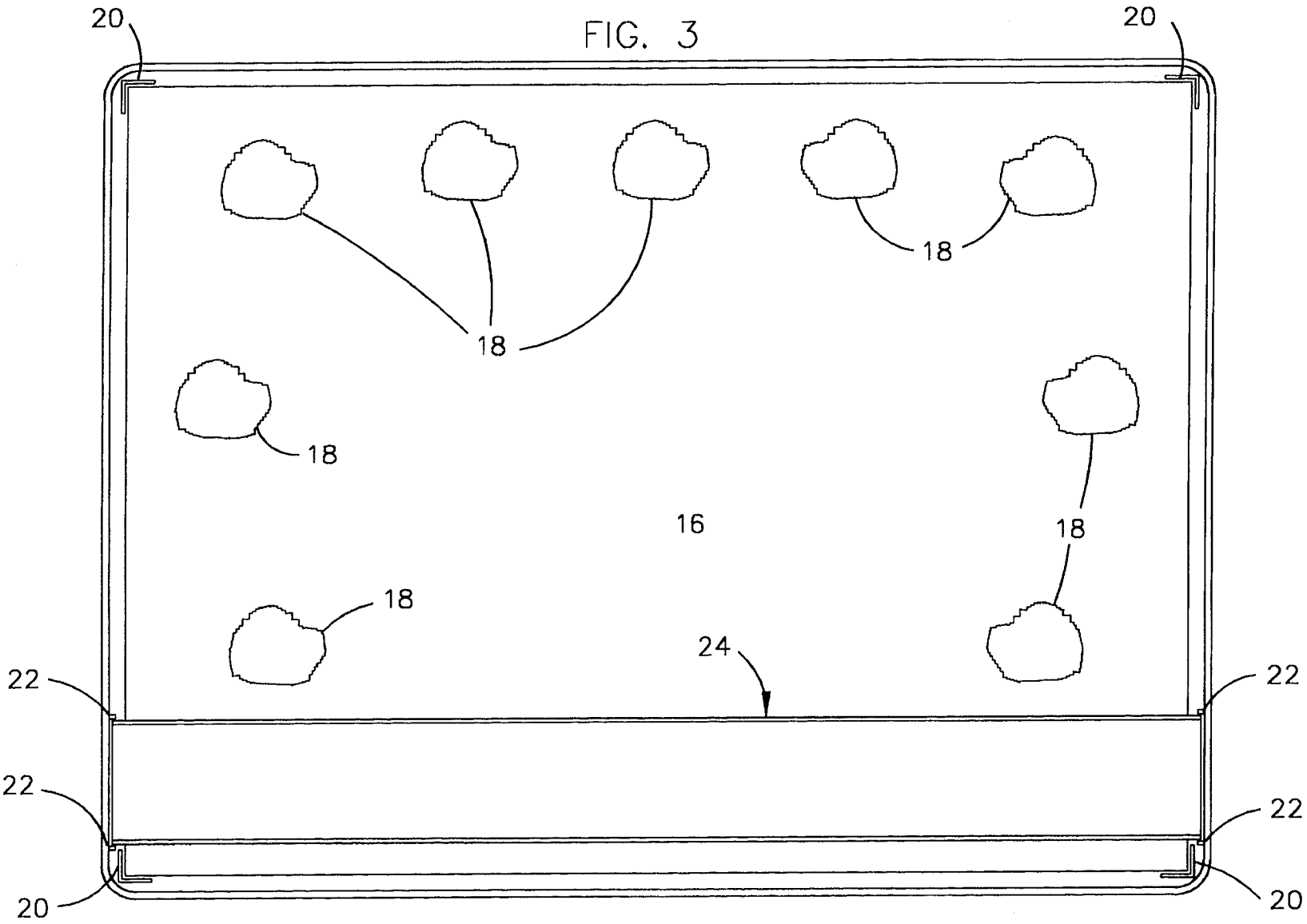
FIG. 3 is a top view of the sealable palette enclosure of FIG. 1 with its lid removed.

Referring now to FIG. 3, lid 14 is removed to expose palette 16 lying on the bottom wall of the box 12. The plate can be either a tablet of palette paper or a reusable palette. For illustrative purposes only, a plurality of separate mounds of paint 18 are shown randomly placed on the top surface of the paper palette. The number and placement of the mounds depend on the preferences and needs of the individual artist. Other types of palettes can also be placed within the box, including those made of plastic and paperboard.

The box is injection molded using a plastic such as polypropylene having a neutral or, preferably, charcoal grey color. The charcoal grey color of the surfaces of the box does not "color" light reflected from the inside surfaces of the box that would otherwise tend to tint paint within the enclosure, thus interfering with the mixing and selection of the proper color of paint. The inside surfaces of the box also have a matted finish to reduce glare. The plastic is preferably high grade to maintain the shape of the box and lid and the integrity of a seal between the box and lid even at extreme temperatures. An "L" shaped flange 18 integrally formed with the bottom wall of the box is located in each corner of the box to center the palette within the box and prevent the palette from sliding due the rounded corners of the box resulting from injection molding. Also molded with the box are two sets of vertical rib-like flanges depending from opposite side walls of the box for retaining tray 24 laterally while permitting vertical movement. The tray has a "U" shaped cross-section and rests on top of the palette 16. An artist may place brushes, palette painting knives and other objects covered in paint into the tray. The tray is easily lifted out if it is not being used or if the palette must be removed.

Figure 4:
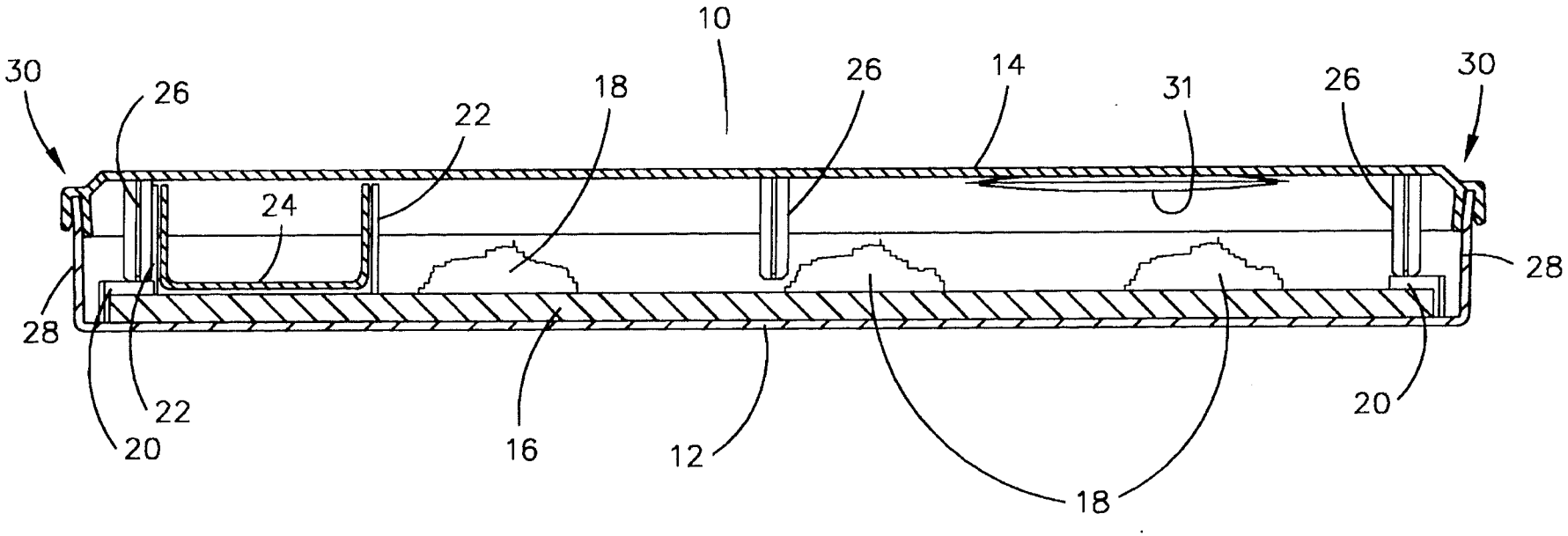
FIG. 4 is a cross-section of the sealable palette enclosure of FIG. 2 taken along section line 4—4.

Referring now to FIG. 4, lid 14 of enclosure 10 is molded of plastic material less rigid than the box such as polyethylene. Integrally formed with the lid are a plurality of spikes 26 that depend from the lid in a downward direction. The spikes cooperate with "L" shaped flanges 20 to retain the palette against the bottom wall of the box, thus providing sufficient clearance between palette and the lid to accommodate the mounds of paint 18. The lid attaches to the top edge of each of the four side walls 28 of the box and forms therewith a seal 30. The lid may be released and replaced by pushing it onto and pulling it away from the box.

An adhesive backed package 31 containing an oxygen scavenging material such as ferrous salts is stuck to the underside of lid 14. The adhesive should be tacky enough for the package to stick but permit easy removal for replacement when the oxygen absorbing capacity of the package has been used up. The package is formed from an air permeable web material. The package could, alternately, be placed under the palette 16 to prevent the package from falling into the mounds of paint 18 during transport. The package is thin enough to be placed under the palette. The length of spikes 26 are short enough to permit a palette of conventional thickness to be raised to accommodate the package. The bottom of the box could, additionally, be formed with a plurality of footings which support the palette in a stable position at a height above the bottom surface that is sufficient to place the package under the palette.

Figure 5:
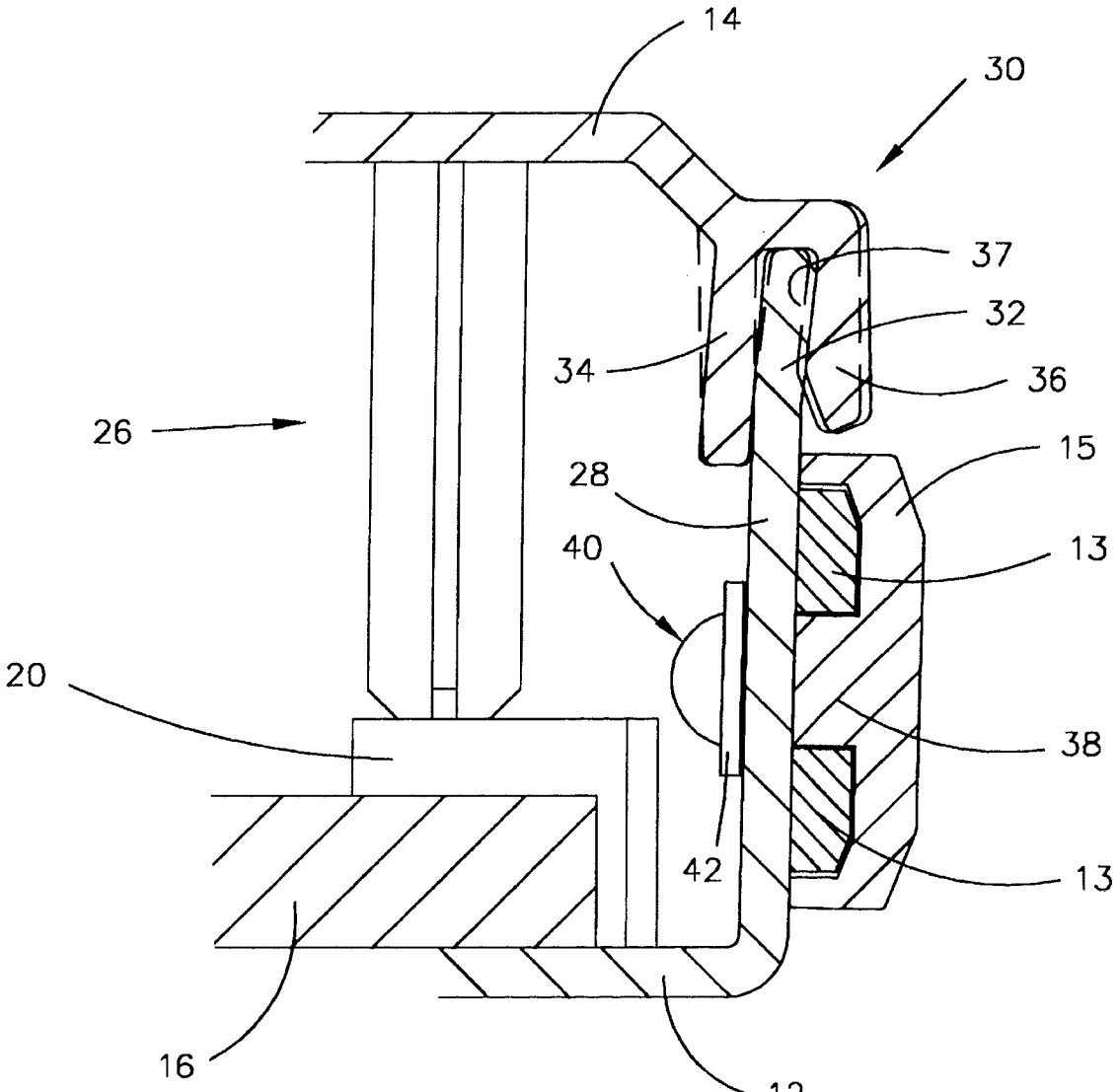
FIG. 5 is a cross-section of the sealable palette enclosure of FIG. 1 taken along section line 5—5.

Referring now to FIG. 5, to form the air-tight seal 30, a top portion 32 of each side wall 28 forms a lip that fits within a channel extending around the perimeter of the lid and formed between an inner flange 34 and an outer flange 36. The top portion 32 of each side wall is bent slightly outwardly. When the channel of the lid is fitted over the lip of the side walls, it bends the inner flange inwardly and the outer flange slightly outwardly. The dashed lines indicate the positions of the flanges prior to insertion of the lip. Due to their resiliency, the bending of the inner and outer flanges forces surfaces of the flanges against surfaces of the top portion of the side wall, thus forming an air-tight seal. An angled inside surface 37 of the outer flange 36 is angled in the same direction as the top portion 32 of each side wall 28. The angled inside surface 37 of the outer flange cooperates with the bent top portion of the side walls to resist upward movement that tends to separate the lid and the box and thus tends to secure the cover on the box. It also tends to increase the surface area of contact between the flange and the wall, thereby improving the seal.

The retractable strap handle 13 is formed of a bendable but somewhat resilient plastic. Only the point of attachment of one of the two ends of the strap handle to the enclosure 10 is shown. The other end of the strap handle is attached to the enclosure in the same manner. The retractable strap handle includes at one end an elongated slot (seen only in cross-section) for permitting the strap to slide laterally with respect to a hollow boss formed on handle connector 15. The boss extends through the slot and into a hole formed in one of the four side walls 28. Shaft of screw 40 extends through the boss and secures the connector to the enclosure. The head of screw 40 presses washer 42 against the side wall 28, thus sealing the hole in the enclosure through which the shaft of the screw extends. The resiliency of the strap normally forces each of its ends into connectors 15. Grasping the middle of the strap handle pulls it away from the enclosure and pulls its ends out from the connectors 15. The slot allows the ends of the strap to be pulled out of the connector in a direction parallel to the side wall a predetermined distance before being stopped by the boss.

The forgoing description of a preferred embodiment is one example of the invention and should not be construed as limiting the invention's scope. Substitutions, rearrangements, additions, omissions and other modifications to the described embodiment are possible without departing from the invention set forth in the appended claims.

What is claimed is:

1. An enclosure for storing artist's paints on a palette comprising:

a substantially rectangular box having a bottom wall and four side walls depending substantially perpendicularly from the bottom wall, the four side walls each having edges defining an opening to the enclosure;

a palette having at least one or more mound of paint placed thereon and positioned within the enclosure:

a lid for sealing the opening;

an oxygen scavenging material contained within an air-permeable package having means for attaching to an inside surface of the enclosure.

2. The enclosure of claim 1 wherein the means for attaching includes an adhesive for removably adhering the package to an inside surface of the enclosure.

3. The enclosure of claim 1 wherein:

the edges of each of the four side walls includes a lip portion canted slightly from the wall; and the lid includes a channel along its periphery for receiving the lip portions of the side walls; the channel defined between a first flange and a second flange depending from the lid, wherein the first flange has an inside surface angled slightly in the direction of the cant of the lip portions of the side walls for cooperating with the lip to retain the lid on the box and both flanges are spaced apart and resilient such that, when the lip portions of the side walls are inserted into the channel, the first and the second flanges bend away from the lip and press against the lip.

4. The enclosure of claim 1 wherein the box is molded plastic having a neutral color.

5. The enclosure of claim 1 further including a handle fixed to one of the four sides of the box.

6. An enclosure for storing artist's paints on a palette comprising:

a substantially rectangular box having a bottom wall and four side walls depending substantially perpendicularly from the bottom wall, the four side walls each having edges defining an opening to the enclosure, the edges of each of the four side walls including a continuous lip portion canted outwardly around the opening;

a lid for sealing the opening, the lid including a channel along its periphery for receiving the lip portion, the channel being defined between first and second resilient flanges depending from the lid, wherein the first flange has an inside surface angled slightly in the direction of the cant of the lip portion for cooperating with the lip to retain the lid on the box and wherein both flanges are spaced apart from each other such that, when the lip portion is inserted into the channel, the first and the second flanges bend away from, and press against, the lip;

a plurality of projections extending substantially perpendicular from the inside surface of the lid to a point to near the bottom wall of the box for holding an artist's palette substantially against the bottom wall of the box; and an oxygen scavenging material contained within an air-permeable package having means for attaching to an inside surface of the enclosure.

7. The enclosure of claim 6 wherein the means for attaching includes an adhesive for removably adhering the package to an inside surface of the enclosure.

8. The enclosure of claim 6 wherein the box and lid are molded plastic having a neutral color.

9. The enclosure of claim 6 further including a retractable handle attached to one of the four sides of the box.

10. The enclosure of claim 6 further comprising at least two L-shaped flanges extending from the bottom wall and positioned for restraining lateral movement of the palette.

11. The enclosure of claim 11 wherein the box and the lid comprises molded plastic having a neutral color.

12. The enclosure of claim 10 further comprising a retractable handle attached to one of the four sides of the box.

13. A method for storing artist's paints on a palette in an enclosure comprising the steps of:

inserting a palette having one or more mounds of paint thereon in a box having a bottom wall and four side walls depending substantially perpendicularly from the bottom wall, the four side walls each having edges defining an opening to the box;

inserting into the box an air-permeable package of oxygen absorbing material; and sealing the opening with a lid to produce a substantially airtight enclosure.

14. The method of claim 13 wherein the step of inserting the air permeable package of oxygen absorbing material includes the step of removably attaching the package to an inside surface of the enclosure using an adhesive.

15. The method of claim 14 further comprising the steps of:

positioning the palette in a predetermined location between at least two L-shaped flanges extending from the bottom wall of the box for substantially restraining the palette against lateral movement; and substantially holding the palette against the bottom wall using one or more projections extending downwardly from the lid to a point near the bottom wall.

16. The method of claim 13 further comprising the steps of:

positioning the palette in a predetermined location between at least two L-shaped flanges extending from the bottom wall of the box for substantially restraining the palette against lateral movement; and substantially holding the palette against the bottom wall using at least one projection extending downwardly from the lid, to a point near the bottom wall.

* * * * *